US008727846B2

(12) United States Patent
McGovern et al.

(10) Patent No.: US 8,727,846 B2
(45) Date of Patent: May 20, 2014

(54) METHOD AND APPARATUS FOR PLAYING A GAME

(76) Inventors: John E. R. McGovern, Havertown, PA (US); Sarah B. McGovern, Havertown, PA (US)

( * ) Notice: Subject to any disclaimer, the term of this patent is extended or adjusted under 35 U.S.C. 154(b) by 0 days.

(21) Appl. No.: 13/300,357

(22) Filed: Nov. 18, 2011

(65) Prior Publication Data

US 2012/0129599 A1 May 24, 2012

Related U.S. Application Data

(60) Provisional application No. 61/415,492, filed on Nov. 19, 2010.

(51) Int. Cl.
*A63F 13/10* (2006.01)

(52) U.S. Cl.
CPC ..... *A63F 13/10* (2013.01); *A63F 2300/807* (2013.01)
USPC ..... 463/9

(58) Field of Classification Search
CPC ... A63F 3/00119; A63F 3/00006; A63F 3/04; A63F 9/0076; A63F 2001/008; A63F 2003/00018; A63F 2003/00123; A63F 2003/00135; A63F 2009/186; A63F 2009/188; A63F 2009/245; A63F 2009/2448; A63F 2009/2457; A63F 2009/247; A63F 2009/2485; A63F 2009/2486; A63F 2011/0095; A63F 2300/8023; A63F 2300/807; A63F 2300/8088; A63F 2300/8094
USPC ..... 463/9, 30, 31, 40–42; 273/293, 296, 273/208, 299–302, 236, 242, 243, 248, 249, 273/429–431; 725/133, 141, 153
See application file for complete search history.

(56) References Cited

U.S. PATENT DOCUMENTS

| | | | | | |
|---|---|---|---|---|---|
| 4,339,798 | A | * | 7/1982 | Hedges et al. | 463/26 |
| 4,372,558 | A | * | 2/1983 | Shimamoto et al. | 463/41 |
| 4,520,404 | A | * | 5/1985 | Von Kohorn | 386/234 |
| 4,605,973 | A | * | 8/1986 | Von Kohorn | 386/234 |
| 4,745,468 | A | * | 5/1988 | Von Kohorn | 725/141 |
| 4,876,592 | A | * | 10/1989 | Von Kohorn | 725/23 |
| 4,926,255 | A | * | 5/1990 | Von Kohorn | 725/23 |
| 4,932,667 | A | * | 6/1990 | Gorski et al. | 273/249 |
| 5,034,807 | A | * | 7/1991 | Von Kohorn | 725/5 |
| 5,057,915 | A | * | 10/1991 | Von Kohorn | 463/9 |
| 5,120,065 | A | * | 6/1992 | Driscoll et al. | 273/237 |
| 5,128,752 | A | * | 7/1992 | Von Kohorn | 705/7.29 |
| 5,227,874 | A | * | 7/1993 | Von Kohorn | 705/7.32 |
| 5,249,044 | A | * | 9/1993 | Von Kohorn | 725/23 |
| 5,283,734 | A | * | 2/1994 | Von Kohorn | 463/17 |
| 5,697,844 | A | * | 12/1997 | Von Kohorn | 463/40 |
| 5,759,101 | A | * | 6/1998 | Von Kohorn | 463/40 |
| 5,800,268 | A | * | 9/1998 | Molnick | 463/40 |
| 5,916,024 | A | * | 6/1999 | Von Kohorn | 463/40 |

(Continued)

*Primary Examiner* — David L Lewis
*Assistant Examiner* — Matthew D Hoel

(57) ABSTRACT

The present invention is a game of verbal charades. In one embodiment, the game is played using a game board, game pieces, a die, a timer, various sets of cards, and an electronic medium containing imitations of people. The game may be played with multiple teams or players or with one person. In another embodiment, the game is played on a portable media device. In another embodiment, the game board includes electronic features allowing the game to be played primarily using the game board. In another embodiment, the game board, cards, timer, and die are represented on a television or other electronic screen.

19 Claims, 7 Drawing Sheets

(56) References Cited

U.S. PATENT DOCUMENTS

| | | | | |
|---|---|---|---|---|
| 5,993,314 | A * | 11/1999 | Dannenberg et al. | 463/1 |
| 6,001,016 | A * | 12/1999 | Walker et al. | 463/42 |
| 6,257,982 | B1 * | 7/2001 | Rider et al. | 463/31 |
| 6,361,437 | B1 * | 3/2002 | Walker et al. | 463/23 |
| 6,364,314 | B1 * | 4/2002 | Canterbury | 273/274 |
| 6,434,398 | B1 * | 8/2002 | Inselberg | 455/517 |
| 6,443,840 | B2 * | 9/2002 | Von Kohorn | 463/17 |
| 6,527,638 | B1 * | 3/2003 | Walker et al. | 463/25 |
| 6,650,903 | B2 * | 11/2003 | Inselberg | 455/517 |
| 6,968,243 | B1 * | 11/2005 | Oh | 700/91 |
| 6,975,878 | B2 * | 12/2005 | Inselberg | 455/517 |
| 6,996,413 | B2 * | 2/2006 | Inselberg | 455/517 |
| 6,999,083 | B2 * | 2/2006 | Wong et al. | 345/473 |
| 7,123,930 | B2 * | 10/2006 | Inselberg | 455/517 |
| 7,248,888 | B2 * | 7/2007 | Inselberg | 455/517 |
| 7,278,930 | B2 * | 10/2007 | Yokota et al. | 473/378 |
| 7,446,772 | B2 * | 11/2008 | Wong et al. | 345/473 |
| 7,458,894 | B2 * | 12/2008 | Danieli et al. | 463/42 |
| 7,522,930 | B2 * | 4/2009 | Inselberg | 455/517 |
| 7,632,186 | B2 * | 12/2009 | Spanton et al. | 463/40 |
| 8,025,572 | B2 * | 9/2011 | Spanton et al. | 463/42 |
| 8,303,413 | B2 * | 11/2012 | Geist et al. | 463/40 |
| 8,353,750 | B2 * | 1/2013 | Patchen | 463/9 |
| 2001/0003099 | A1 * | 6/2001 | Von Kohorn | 463/40 |
| 2002/0032049 | A1 * | 3/2002 | Walker et al. | 463/16 |
| 2002/0108125 | A1 * | 8/2002 | Joao | 725/139 |
| 2002/0119823 | A1 * | 8/2002 | Beuscher | 463/42 |
| 2003/0003990 | A1 * | 1/2003 | Von Kohorn | 463/25 |
| 2003/0220143 | A1 * | 11/2003 | Shteyn et al. | 463/42 |
| 2004/0162141 | A1 * | 8/2004 | Stienstra | 463/36 |
| 2005/0113170 | A1 * | 5/2005 | McHugh | 463/40 |
| 2005/0272495 | A1 * | 12/2005 | Penner et al. | 463/1 |
| 2006/0058103 | A1 * | 3/2006 | Danieli et al. | 463/42 |
| 2006/0068824 | A1 * | 3/2006 | Inselberg | 455/517 |
| 2006/0082068 | A1 * | 4/2006 | Patchen | 273/430 |
| 2007/0099684 | A1 * | 5/2007 | Butterworth | 463/1 |
| 2007/0117617 | A1 * | 5/2007 | Spanton et al. | 463/29 |
| 2007/0117635 | A1 * | 5/2007 | Spanton et al. | 463/43 |

* cited by examiner

METHOD AND APPARATUS FOR PLAYING A GAME

CROSS REFERENCE TO RELATED APPLICATION

This application claims the benefit of U.S. Provisional Application No. 61/415,492, filed Nov. 19, 2010, the content of which is hereby incorporated by reference herein.

FIELD OF INVENTION

The present invention is generally related to games. More particularly, the present invention relates to methods and apparatuses for playing a game.

BACKGROUND

A board game is a game played by placing and/or moving markers or pieces along a board or other demarcated surface. Simple board games use markers or pieces along with other items such as dice or cards. More sophisticated board games use additional items such as props or toys. Board games are viewed as entertainment and provide entertainment for a wide variety of age groups. Board games also provide educational value as they provide an opportunity to build communication skills and increase intelligence.

Computers, cell phones, and other electronic devices have allowed games to be implemented in software code for use in those types of devices. Games can be played with one or more players on one computer or using multiple computers. Games can also be played on the internet with one or more users each playing on their own computer. Electronic devices used to play games include gaming systems, cellular telephones, and electronic media devices. Televisions, computer monitors, and other devices may also be used to display all or part of a game.

SUMMARY

The present invention is a game of verbal charades. The game may be played using a game board, game pieces, a die, a timer, various sets of cards, and/or an electronic medium containing imitations of people. The game may be played with multiple teams or players or with one person. The game may be played on a portable media device. The game board may include electronic features allowing the game to be played primarily using the game board. The game board, cards, timer, and die may be represented on a television or other electronic screen.

BRIEF DESCRIPTION OF THE DRAWINGS

A more detailed understanding may be had from the following description, given by way of example in conjunction with the accompanying drawings wherein.

DETAILED DESCRIPTION

The present invention will now be described with reference to the drawings. As used herein, the terms "game" and "board game" are interchangeable and include, but are not limited to, a traditional meaning of a game or board game as well as a game playable on a computer or other electronic device.

Figure 1:
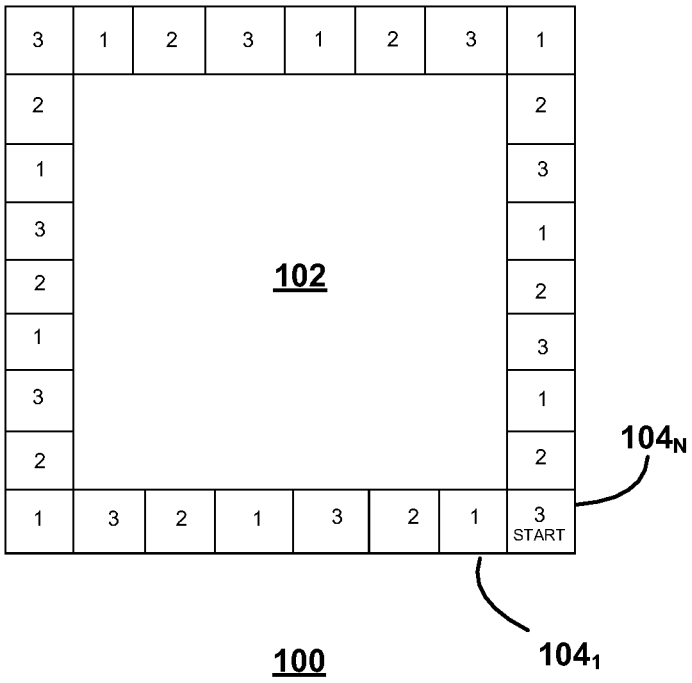
FIG. 1 is an example of a game board in accordance with the present invention.

FIG. 1 is an example 100 of a game board 102 in accordance with the present invention. The game board 102 is preferably a square and may include any number of spaces $\mathbf{104}_1$-$\mathbf{104}_N$. Each space 104 may be a square (or any other shape) and may be organized around the perimeter of the game board 102. Each space 104 may be designated, for example, by a particular number or color. The number or color of each space 104 may designate a particular action to be taken by a user. As an example, each space 104 in FIG. 1 is designated in an alternating manner with a '1,' '2,' or '3.' Each number in FIG. 1 may also correspond to a particular color. The contents and layout of the game board 102 may be varied as desired.

The game may also include a plurality of game pieces, which may also be referred to as "movers." The game pieces may be moved around the game board 102 and are used to mark a location on the game board 102. The game pieces may be distinguished from each other, for example, by color, size, shape, or design. Each game piece may correspond to a particular player or group of players. Game pieces may start at a space 104 marked "START." The same space 104 may be used as the last square that completes the game and may be marked "FINISH." Optionally, this final square may be multi-colored or multi-numbered. A multi-colored or multi-numbered square may indicate that a team may choose to act as if the square is any one of the colors shown.

The game may also include at least one six-sided numbered die. The at least one die may be rolled to determine how many spaces 104 a game piece moves each turn. Each player or team may roll the at least one die each turn. Each player or team may also roll the at least one die at the beginning of the game to determine which player or team will start the game. For example, the player or team with highest die roll will begin the game.

The game may also include a timer. The timer may be in the form of a sand timer, but of course may be any type of timer. The timer may last any duration of time. For example, the timer may be a one-minute timer. The timer may be used during gameplay to determine the amount of time that a team has to complete a task.

The game may also include at least one set of cards. Each set of cards may be a particular color and may correspond to a particular "category." One example of a category is "Situational." According to one embodiment of the present invention, cards used for the Situational category are yellow. On one side of each Situational card, a voice and/or dialect is listed, a situation is described, and quoted words or phrases are provided. One or more of the quoted words may be underlined.

Another example of a category is "Occupational." According to this embodiment of the present invention, cards used for the Occupational category are red. The Occupational category is considered a free-form category. On one side of each Occupational card, three occupations are listed.

Any number of categories or colors may be used and the game board 102 may be designed and colored to accommodate the use of any number of categories or colors. For example, another category may be a "Miscellaneous" category, allowing players to act out a wide variety of people or things that do not relate to one particular category. As an additional example, there may be a "People" category, allowing players to act out specific people. The people may include, for examples, presidents, celebrities, athletes, or any other recognizable person.

The game may also include a DVD or other similar medium. The DVD may contain imitations. The imitations may be of recognizable public figures. The imitations on the DVD may be played on a television or on any other electronic screen. Although the term "DVD" is used throughout the specification for exemplary purposes, one skilled in the art will recognize that any medium or electronic format may be used.

Figure 2:
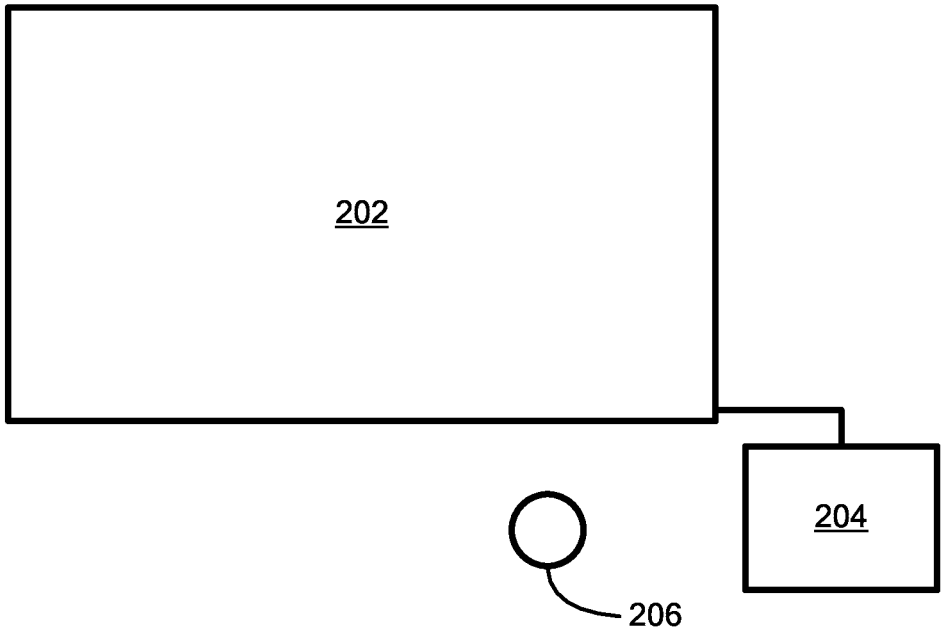
FIG. 2 shows an example of the game board along with a television and media player capable of playing an electronic portion of the game.
Figure 2:
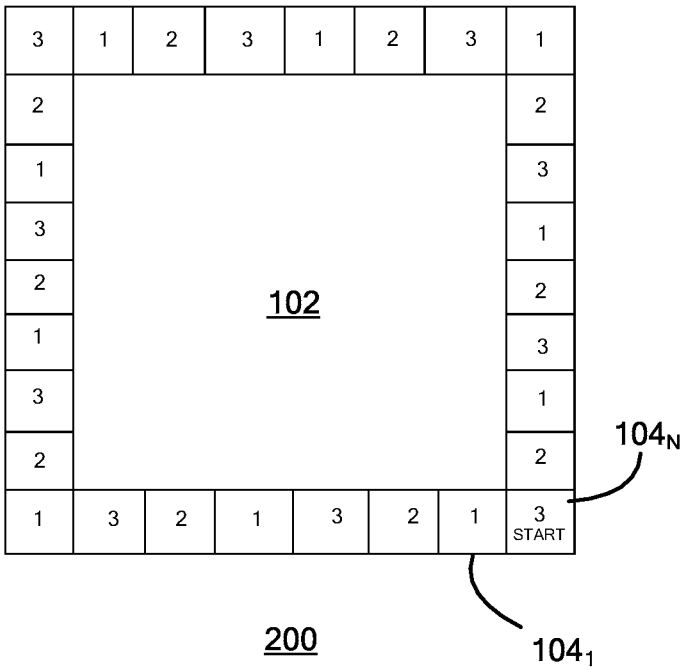

FIG. 2 shows an example 200 of the game board 102 along with a television 202 and media player 204 capable of playing an electronic portion of the game. The game board 102 shown is in accordance with the game board 102 described in reference to FIG. 1. FIG. 2 further includes a television 202, a media player 204, and a DVD 206 (or other medium). The DVD 206 includes imitations and is intended to be played by the media player 204 and displayed on the television 202. In certain situations during gameplay, players may play a "DVD" category and are required to play and watch the DVD 206 on the television 202. Each time the DVD category is played, one imitation may be played. A clock on the screen counts down from a predetermined time to 0. After the clock expires, the person being imitated (the answer) is revealed. A player may then "pause" the DVD 206 until the DVD category is played again. Optionally, the DVD 206 may have the capability of scrambling the image displayed on the screen before someone plays a particular imitation. Further, the DVD 206 may include "bookmarks" so that the DVD 206 may be resumed from a particular location at a later point in time.

Figure 3:
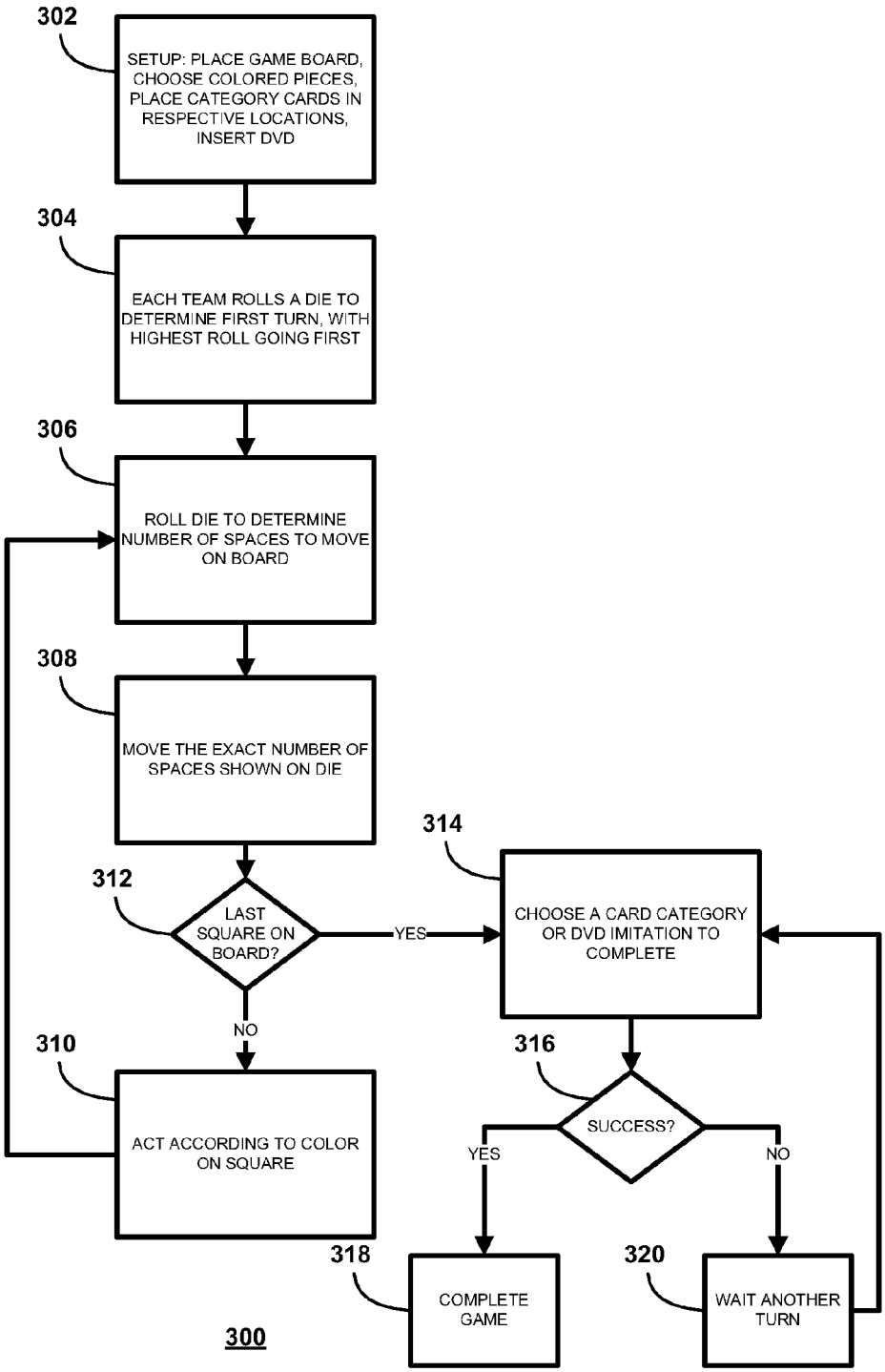
FIG. 3 is a flow diagram of a method for playing the game of the present invention with multiple teams.

FIG. 3 is a flow diagram of a method 300 for playing the game of the present invention with multiple teams. First, setup 302 of the game may occur. Setup 302 may include placing the game board 102 in view of all players. Two or more teams may be formed with at least two players per team. At given times, each team may include one "presenter" and at least one "guesser." Players on each team may alternate roles throughout the game. In other embodiments, more than two teams may be formed or one player may play individually. Each team may choose a colored game piece that is used to move around the game board 102. Each set of cards may be placed on or near the game board 102. Optionally, the game board 102 may include designated spaces on which each set of cards may be placed. The DVD 206 is inserted into the media player 204 and remains paused until used. Each team may roll a die to determine which team has the first turn 304. The team with the highest roll may receive the first turn. Optionally, teams must play and successfully complete the first square before proceeding to roll the dice to move forward along the game board 102.

Each turn, a player may roll the die 306 and move their game piece the number of spaces shown on the die 308. Upon landing on a particular space 104, the team may act 310 according to the color indicated on the space 104. For example, a blue space 104 may indicate the "DVD" category, a yellow space 104 may indicate the "Situational" category, and a red space 104 may indicate the "Occupational" category. The team may then attempt to successfully complete their turn according to the rules of the particular category and card. Upon successful completion of a turn, the successful team may roll 306 again. Upon unsuccessful completion of a turn, it may become the other team's turn. Teams may continue to proceed around the game board 102. To successfully land on the last space 104 on the game board 102, a team does not have to roll the die the exact number of spaces needed to land directly on the last square. For example, if a game piece is located one space away from the last square, rolling a "5" allows the game piece to move to the last square.

The last square on the board may be multi-colored. A team landing on the last, multi-colored square 312 may choose a card or DVD category to attempt to successfully complete 314. The team may successfully complete the card or category or may be unsuccessful 316. If the team successfully completes the category, the game is completed 318. If the team does not successfully complete the category, the game piece stays on the last square and team must wait another turn to try again 320.

Figure 4:
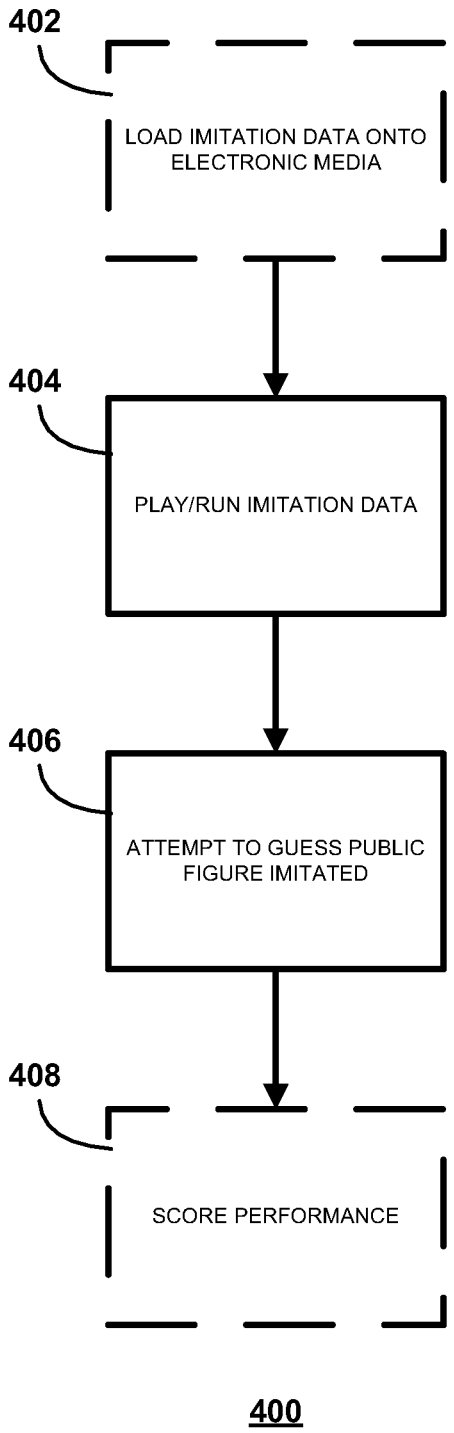
FIG. 4 is a flow diagram of a method for playing the game of the present invention with one player.

FIG. 4 is a flow diagram of a method 400 for playing the game of the present invention with one player. Optionally, data or files containing imitations of various people are loaded 402 onto electronic media or an electronic device. Electronic media and devices may include, for example, a computer, a cellular telephone, a portable media player, a gaming console, or any other electronic device. The imitation data is then played 404 from the location in which it is stored. Similarly, the imitation data may be played directly from a particular type of media, such as a CD, a DVD, or the like. One or more players then attempt to guess 406 the person being imitated. The electronic media may be configured to score the performance of the player or multiple players. For example, the user may be prompted to enter the answer via an input element. The answer may be input, for example, by typing an answer using buttons, verbally saying the answer, or by selecting an answer from a list. The electronic media or device may use this information to score the performance 408 of the player or players.

Figure 5:
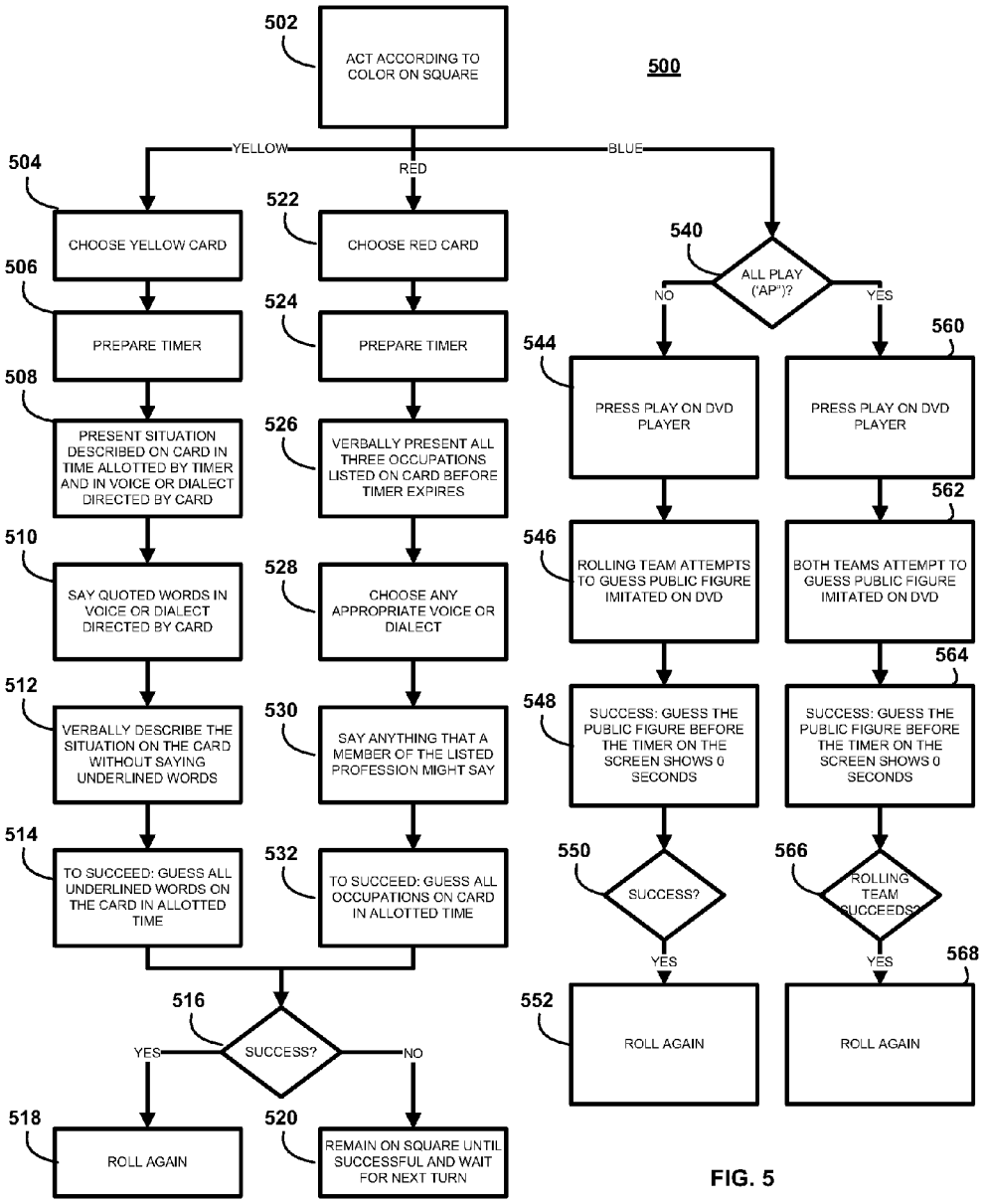
FIG. 5 is a flow diagram providing instructions and rules for gameplay according to one embodiment of the present invention.

FIG. 5 is a flow diagram of an example method 500 of instructions and rules for gameplay according to one embodiment of the present invention. If a team's game piece lands on a particular square, the team may be required to act according to the color on the square 502. If a game piece lands on a yellow square, the team may select a yellow "Situational" card 504. The team may choose one player on the team to be the presenter. The one or more other players may be the guessers. The timer is prepared 506 to be started when the team begins presenting. On one side of each Situational card, a voice and/or dialect is listed, a situation is described, and quoted words or phrases are provided. One or more of the quoted words may be underlined. The presenter must verbally present the situation described on the card 508 in the voice and/or dialect directed by the card 510. The one or more guessers may attempt to guess all of the words that are underlined on the card. The presenter may read the quoted words or phrases that were provided. If the quoted words or phrases did not fully assist the guessers, the presenter may verbally describe the situation on the card, but may not say the underlined words 512. To successfully complete a card for the Situational category, the guessers must correctly guess all underlined words listed on the card before the timer expires 514. A team may be successful or unsuccessful 516. If the team is successful, the team rolls again 518 and proceeds to roll again until unsuccessful. Each time a team presents a card, the player acting as the presenter may change. If the team is unsuccessful, the team may remain on the space 520 and successfully complete the category before the team may roll again. The performance for each card may be scored and the team may receive one or more points for successful completion of the card.

Still referring to FIG. 5, if a game piece lands on a red square, the team may select a red "Occupational" card 522. The team may choose one player on the team to be the presenter. The one or more other players may be the guessers. The timer may be prepared 524 to be started when the team begins presenting. On one side of each Occupational card, three occupations are listed. A presenter may verbally present all three occupations listed on the card before time expires 526. The Occupational category is considered a free-form category. No dialects or voices may be directed by the card. The presenter may pick any voice or dialect 528 that is appropriate. The presenter may say anything that someone in the given occupation might say 530. To successfully complete a card for the Occupational category, one or more guessers may correctly guess all three occupations listed on the card before the timer expires 532. The team may be successful or unsuccessful 516. If the team is successful, the team rolls again 518 and proceeds to roll again until unsuccessful. Each time a team presents a card, the player acting as the presenter must change. If the team is unsuccessful, the team may remain on the space 520 and successfully complete the category before the team may roll again. The performance for each card may be scored and the team may receive one or more points for successful completion of the card.

As explained above, any number of card categories may be used. Any categories in addition to the Situational and Occupational categories described above may follow the general rules for drawing a card, presenting the card, and guessing the material described on the card. Additionally, each category may include category-specific rules that are applicable only to that category.

Further, all card categories may use a general set of rules to be adhered to during presentation of the card. The presenter may be required to change his or her voice from his or her actual voice while presenting the card. A presenter may not be allowed to use props or any bodily movements, with the exception of using one's voice. The presenter may not verbally state any root words or derivative words of any words specifically forbidden by the particular card or category. For example, while presenting a Situational card, the presenter may not use any root words or derivative words of the underlined words. As another example, while presenting an Occupational card, the presenter may not use any root words or derivative words of the given occupations. For example, if "lawyer" is the given occupation, the presenter may not say "law" or "lawyering." As a further example, while presenting for a "People" category, the presenter may not use any derivative words or words that share a common word with the person listed on the card.

The presenter may also not be allowed to ask any questions to the guessers. Similarly, the guessers may not ask the presenter any questions. No conversations are allowed and the verbal portion may be restricted such that only a presenter is allowed to speak. As an example, if a guesser guesses "car," but the underlined words are "fast car," the presenter may not encourage or aide the guesser by asking "what kind of car?"

The non-guessing team may assign a judge during each turn to determine whether the rules are adhered to. Prior to each turn involving card categories, the presenter may show the card to the judge from the other team so that the judge knows which words are supposed to be presented and which words are not allowed to be used. If the presenter violates any rule, the judge may verbally indicate the violation. For example, the judge may yell "verbal violation" or "body violation," depending on the violation. If a violation occurs, the guessing team loses the current turn and it becomes the non-guessing team's turn.

Referring again to FIG. 5, if a game piece lands on a blue square, the "DVD" category is indicated. Certain blue squares may be marked with "AP," indicating "All Play" 540. If the blue square is not marked with "AP" 540, the DVD category for that turn is not considered an "All Play" turn. The team landing on the blue square may play the DVD 544. All players on the team may attempt to guess the person being imitated 546 by the DVD actor before the time clock on the screen reaches "0" 548. The amount of time allotted for each imitation may vary and is shown when the imitation is first played. The answer to each imitation appears at the end of the imitation. The team may then "pause" the DVD 206. If the team guesses correctly and is successful 550, the team may roll the die again 552. If no player guesses correctly, it becomes the other team's turn. On the team's next turn, the team must successfully complete the square before rolling again.

If the blue square is marked "AP" to indicate "All Play" 540, then all players on both teams may attempt to guess the person being imitated by the DVD actor. The team landing on the blue square plays the DVD 560. Both teams may attempt to guess the public figure being imitated on the DVD 562. The first player to successfully identify the person being imitated wins. If the successful player is on the team that landed on the square 566, the team rolls again 568. If the successful player is not on the team that landed on the square, the team may then attempt to successfully complete the square that the team landed on during the previous turn.

Figure 6:
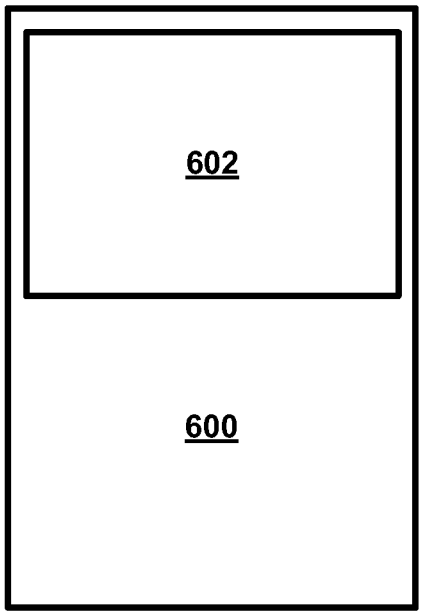
FIG. 6 shows a portable media device capable of playing the game according to the present invention.

FIG. 6 shows a portable media device 600 capable of playing the game according to the present invention. The portable media device 600 may include a screen 602. An electronic version of the game may be loaded onto the portable media device 600. The portable media device 600 may be a cellular telephone capable of running an application version of the game. The portable media device 600 may also be any device capable of storing and running software. The game may include both a one-player and a multi-player version of the game. The one-player version may be played according to any of the embodiments described above. The one-player version may also be played according to the method described above in relation to FIG. 4. The multi-player version may be played according to any of the embodiments described above. The multi-player version may also be played according to the method described above in relation to FIG. 3 and FIG. 5.

Figure 7:
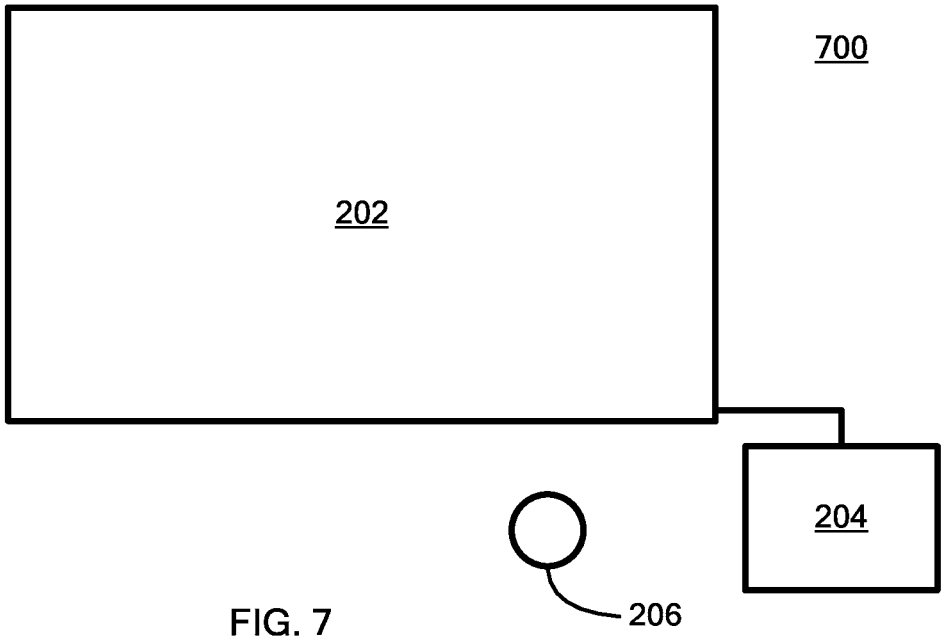
FIG. 7 shows an embodiment of the present invention that does not include a physical game board.

FIG. 7 shows an embodiment 700 of the present invention that may not include a physical game board. The game is stored on a DVD 206 or other medium and played via a television 202. The game board 102 may be displayed on the television 202 and played from the DVD 206 or other medium. The television 202 may also be a touch screen television and may allow the players to control the game by touching the screen. Alternatively or additionally, the players may have an alternate way of communicating with the media player 204 and television 202, such as a remote or controller. For example, a standard television remote control may be used or a video game controller may be used. The other aspects of the present invention, as described above, may also be implemented on the DVD 206 or other medium and displayed via the television 202. Thus, the die may be "rolled"

and shown on the television 202, cards may be "drawn" and shown on the television 202, and game pieces may be "moved around the board" and shown on the television 202. As described above with respect to other embodiments, the DVD imitations may also be displayed on the television 202. Additionally, the electronic version may also be configured to maintain scores for each team. Of course, the present invention is not limited to a television 202 and any type of monitor or display device (including a computer) capable of displaying or being used to display the game board 102 may be used.

Figure 8:
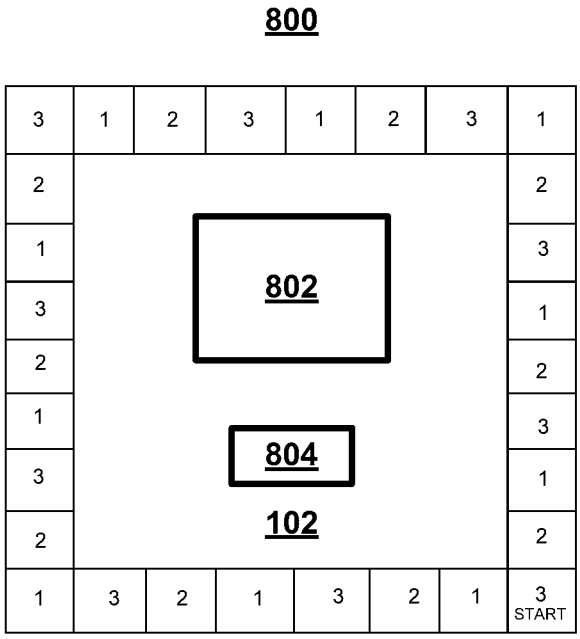
FIG. 8 shows an embodiment of the present invention using a game board that includes electronic components.

FIG. 8 shows an embodiment 800 of the present invention in which the physical game board 102 may also include an electronic display 802 and/or at least one button 804. In addition to all of the features of the game board 102 described above with respect to FIG. 1, the game board 102 may include an electronic display 802 to be used for any of the features of the game. For example, the electronic display 802 may be used to play imitations. The imitations may be displayed as audio only or may be both audio and video. The electronic display 802 may also be used to display cards that are drawn, depending on which square a game piece lands on. Optionally, the electronic display 802 may be pivoted or angled such that only the presenter or only a select group of players may view the screen. The game board 102 may also include a button 804. The button 804 may be pressed to simulate a roll of the die. The button 804 may also be used for any other part of the game described herein. The results of the die roll may then be displayed on the electronic display 802.

The present invention may be implemented in a computer program tangibly embodied in a computer-readable storage medium containing a set of instructions for execution by a processor or a general purpose computer; and method steps of the invention can be performed by a processor executing a program of instructions to perform functions of the invention by operating on input data and generating output data. Suitable processors include, by way of example, both general and special purpose processors. Typically, a processor will receive instructions and data from a ROM, a random access memory (RAM), and/or a storage device. Storage devices suitable for embodying computer program instructions and data include all forms of non-volatile memory, including by way of example semiconductor memory devices, magnetic media such as internal hard disks and removable disks, magneto-optical media, and optical media such as CD-ROM disks and digital versatile disks (DVDs). In addition, while the illustrative embodiments may be implemented in computer software, the functions within the illustrative embodiments may alternatively be embodied in part or in whole using hardware components such as Application Specific Integrated Circuits (ASICs), Field Programmable Gate Arrays (FPGAs), or other hardware, or in some combination of hardware components and software components.

Although features and elements are described above in particular combinations, one of ordinary skill in the art will appreciate that each feature or element can be used alone or in any combination with the other features and elements.

What is claimed is:

1. A method for playing a game comprising:

Providing a game board having a plurality of spaces;

providing game pieces, one for each team, for moving along the plurality of spaces of the game board;

providing a set of imitations via an electronic medium, wherein the set of imitations is performed by a third party where such third party is merely an independent performer of verbal imitations of public figures, where such third party verbal imitations are pre-recorded via video or audio format, where such verbal imitations are accessed by a participating player operating an electronic device, whose imitations comprise a category independent from a set of cards, and whose verbal imitations players must correctly identify before an allotted time expires, but such third party is not a spectator, not a judge ensuring fair play, not a feedback-giving player, not a host, not a computer-voice reader of cards, and not a player in the game, providing at least three categories, wherein a first category corresponds to a situation; a second category corresponds to an occupation and a third category corresponds to an imitation, wherein the first category corresponds to a first set of cards, the second category corresponds to a second set of cards and the third category corresponds to the provided set of imitations performed by the third party;

a person describing the contents of a category of the at least three categories according to rules, the rules being specific to a type of the category card, wherein the person describes the at least one situation described on the first set of cards; the person describes the at least one occupation listed on the second set of cards; or displaying one of the provided set of imitations via the electronic medium if the type of the category card is imitations; and a group guessing the contents of the category being described or displayed, the group including at least one person.

2. The method of claim 1, wherein the plurality of spaces of game board are identified by a particular color, each color representing a particular category.

3. The method of claim 1, wherein the game pieces are distinguished by color.

4. The method of claim 1, further comprising a fourth miscellaneous category, wherein at least one miscellaneous person, place, thing, or idea is described on a third set of cards.

5. The method of claim 1, wherein the group includes one player and the one player is:

provided at least one imitation performed by the third party;

prompted to correctly identify at least one of the set of imitations; and scored based on a number of correct identifications.

6. The method of claim 1, wherein the game board further includes an electronic display and a device configured to operate the electronic display.

7. The method of claim 1, wherein the person describing further includes the person describing the contents of the card via a verbal presentation.

8. The method of claim 7, wherein the person describing further includes the person not performing a physical gesturing or acting motion.

9. The method of claim 1, wherein the set of imitations, performed by the third party are provided via audio and video, or via audio.

10. A method for playing a game for use in an electronic device, the method comprising:

providing, at the electronic device, a game board having a plurality of spaces;

displaying, at the electronic device, game pieces, one for each team, for moving along the plurality of spaces of the game board;

providing, at the electronic device, a set of imitations, wherein the set of imitations is performed by a third party where such third party is merely an independent performer of verbal imitations of public figures, where such third party verbal imitations are pre-recorded via video or audio format, where such verbal imitation are accessed by a participating player operating an electronic device, whose imitations comprise a category independent from a set of cards, and whose verbal imitations players must correctly identify before an allotted time expires, but such third party is not a spectator, not a judge ensuring fair play, not a feedback-giving player, not a host, not a computer-voice reader of cards, and not a player in the game;

displaying, at the electronic device, at least three categories, wherein a first category corresponds to a situation; a second category corresponds to an occupation and a third category corresponds to an imitation, wherein the first category corresponds to a first set of cards, the second category corresponds to a second set of cards and the third category corresponds to the provided set of imitations performed by the third party;

prompting, at the electronic device, a person to describe the contents of a category of the at least three categories according to rules, the rules being specific to a type of the category, wherein the person describes the at least one situation described on the first set of cards; the person describes the at least one occupation listed on the second set of cards; or displaying one of the provided set of imitations via the electronic device if the type of the category card is imitations; and prompting, at the electronic device, a group to guess the contents of the category card being described or the one imitation of the provided set of imitations being displayed, the group including at least one person.

11. The method of claim 10, wherein the plurality of spaces of the game board are identified by a particular color, each color representing a particular category.

12. The method of claim 10, wherein the game pieces are distinguished by color.

13. The method of claim 8 further comprising a fourth miscellaneous category, wherein at least one miscellaneous person, place, thing, or idea is described on a third set of cards.

14. The method of claim 10, wherein the group includes one player and the one player is:

provided at least one imitation performed by the third party;

prompted to correctly identify at least one of the set of imitations; and scored based on a number of correct identifications.

15. The method of claim 8, wherein the game board is displayed on a television or monitor.

16. The method of claim 15, further including a device configured to operate the television or monitor.

17. The method of claim 15, wherein the television or monitor includes a touch-screen that allows at least one aspect of the game to be played by touching the touch-screen.

18. The method of claim 10, wherein the set of imitations performed by the third party, are provided via audio and video, or via audio.

19. A non-transitory computer-readable storage medium containing a set of instructions for execution by one or more processors the set of instructions comprising:

a first code segment for providing, via the one or more processors, a game board having a plurality of spaces;

a second code segment for providing, via the one or more processors, game pieces, one for each team, for moving along the plurality of spaces of the game board;

a third code segment for providing, via the one or more processors, a set of imitations, wherein the set of imitations is performed by a third party where such third party is merely an independent performer of verbal imitations of public figures, where such third party verbal imitations are pre-recorded via video or audio format, where such verbal imitations are accessed by a participating player operating an electronic device, whose imitations comprise a category independent from a set of cards, and whose verbal imitations players must correctly identify before an allotted time expires, but such third party is not a spectator, not a judge ensuring fair play, not a feedback-giving, player, not a host not a computer-voice reader of cards, and not a player in the game;

a fourth code segment for providing, via the one or more processors, at least three categories, wherein a first category corresponds to a situation; a second category corresponds to an occupation and a third category corresponds to an imitation, wherein the first category corresponds to a first set of cards, the second category corresponds to a second set of cards and the third category corresponds to the provided set of imitations wherein the set of imitations is performed by the third party;

a fifth code segment for prompting, via the one or more processors, a person to describe the contents of category of the at least three categories according to rules, the rules being specific to a type of the category, wherein the person describes the at least one situation described on the first set of cards; the person describes the at least one occupation listed on the second set of cards; or displaying one of the provided set of imitations via the electronic device if the type of the category is imitations wherein the set of imitations is performed by the third party; and a sixth code segment for prompting, via the one or more processors, a group to guess the contents of the category being described or the one imitation of the provided set of imitations being displayed, wherein the set of imitations is performed by the third party, the group including at least one person.

* * * * *